US005533457A

United States Patent [19]

Cox

[11] Patent Number: 5,533,457

[45] Date of Patent: Jul. 9, 1996

[54] LEVELING MECHANISM ADJUSTABLE GLIDE

[75] Inventor: Lewis D. Cox, Knoxville, Tenn.

[73] Assignee: Falcon Products, Inc., Newport, Tenn.

[21] Appl. No.: 337,060

[22] Filed: Nov. 10, 1994

[51] Int. Cl.[6] ..... A47B 13/02

[52] U.S. Cl. ..... 100/150; 248/188.4

[58] Field of Search ..... 108/144, 150; 248/188.4, 188.2, 188.3, 188.8, 188.9, 677; 16/42 R

[56] References Cited

U.S. PATENT DOCUMENTS

| | | | |
|---|---|---|---|
| 821,225 | 5/1906 | Dozier | 248/188.4 |
| 3,424,413 | 1/1969 | Applegate | 248/188.4 X |
| 4,374,497 | 2/1983 | Harmand . | |
| 4,625,424 | 12/1986 | de la Haye . | |
| 4,679,652 | 7/1987 | Cervantes, Sr. | 248/188.3 X |
| 4,690,365 | 9/1987 | Miller et al. | 248/188.4 X |
| 4,934,647 | 6/1990 | Edwards . | |
| 4,966,341 | 10/1990 | Borsani | 248/188.4 X |
| 5,042,764 | 8/1991 | Carpinella et al. . | |
| 5,071,097 | 12/1991 | Owen . | |
| 5,141,190 | 8/1992 | Wu | 248/188.4 |
| 5,190,255 | 3/1993 | Gianfranchi | 248/188.4 |
| 5,320,049 | 6/1994 | Rowland | 108/150 |

FOREIGN PATENT DOCUMENTS

| | | | |
|---|---|---|---|
| 2416154 | 10/1975 | Germany | 248/188.4 |

*Primary Examiner*—Jose V. Chen

*Attorney, Agent, or Firm*—Polster, Lieder, Woodruff & Lucchesi

[57] ABSTRACT

An adjustable leveling glide assembly for attachment to the foot of a table leg. The glide assembly has a flat, floor engaging glide support positioned under the foot of the table. A threaded stem extends vertically from the support and engages a threaded bore in the foot. An adjusting knob is attached to the upper end of the stem. The adjusting knob is positioned above the foot, preferably recessed in a cavity formed in the top side of the foot. A user can readily manipulate the knob and rotate the stem to draw the support toward the foot or move the support away from the foot and thereby level the table.

19 Claims, 3 Drawing Sheets

LEVELING MECHANISM ADJUSTABLE GLIDE

BACKGROUND OF THE INVENTION

This invention relates generally to furniture, more specifically to a readily accessible adjustable leveling glide for the base of a piece of furniture, particularly a table.

It is commonly known that certain models of tables, particularly commercial or utility tables are equipped with glides under the floor-engaging foot portions of the table legs. These glides serve to protect the surface of the floor and to balance or level the table. For example, the glide may have a smooth flat section or disc that contacts the floor and an upwardly protruding stem that engages the foot of the table. Often, at the juncture of the disc and the stem, there is a joint that allows slight articulation of the disc relative to the stem. This articulation allows the glide disc to rest on slightly uneven surfaces and still maintain the table in a relatively level position. Furthermore, the stems often are threaded and screwed into the foot of the table. If the table is not level, the user can grasp the disc and rotate the stem to extend the glide or shorten the glide. By adjusting one or more of the glides on the table legs, the user can level the table. It will be appreciated that this can be an awkward or cumbersome procedure. The user must grasp and manipulate a glide that is, for the most part, hidden under the foot of a table. If the user cannot access the glide, he or she may have to lift the table off the floor to reach it. This can be difficult or impossible if the table is heavy or laden with objects. Even if access to the guide is available, it is difficult to effect correct positioning of the glides to insure true level table surface. In some cases, a tool, such as an adjustable wrench, is required to turn the stem. This prevents proper leveling in situations where such a tool is not readily available.

SUMMARY OF THE INVENTION

It is, therefore, among the principal objects of the present invention to provide a adjustable leveling glide assembly that is readily accessible and adjustable from the top of foot of the table to allow the user to adjust the glide without lifting the foot of the table off the floor.

It is another object of the invention to provide such an adjustable leveling glide assembly that can be adjusted without the use of a tool.

It is yet another object of the present invention to provide an adjustable leveling glide assembly that has a flat, floor engaging section positioned under the foot of a table, a threaded stem that extends through the foot of the table, and an adjusting knob attached to the stem adjacent to the top of the foot of the table.

Still another object of the present invention is to provide such an adjustable leveling glide assembly having the adjusting knob constructed from a resilient plastic or resin material.

Another object of the present invention is to provide such an adjustable leveling glide assembly that is simple and economical to construct, easy to use, durable, lightweight and well suited for its intended purpose.

Still another object of this invention is to provide an aesthetically pleasing yet functional glide assembly for use in a table.

Briefly stated, an adjustable leveling glide assembly is provided for attachment to the foot of a table leg that is readily accessible and adjustable from the top of the foot.

The glide has a flat, floor engaging disc positioned under the bottom side of the foot of the table. The disc is constructed with a flat lower surface to engage a surface, such as a floor. The disc is connected to one end of a threaded stem. The threaded stem is threadedly engaged in, and extends upwardly through, a threaded bore formed in the foot of the table. There is an adjusting knob attached to the other end of the stem. The adjusting knob is adjacent the top side of the foot of the table leg. The adjusting knob preferably is recessed in a cavity formed in the top side of the foot. The knob handle protrudes above the cavity when the glide is retracted or drawn into the foot. A user can manipulate the adjusting knob handle and rotate the stem within the threaded bore to draw the disc toward the foot or move the disc away from the foot to adjust the height of the glide and thereby level the table.

DESCRIPTION OF THE PREFERRED EMBODIMENT

Figure 1:
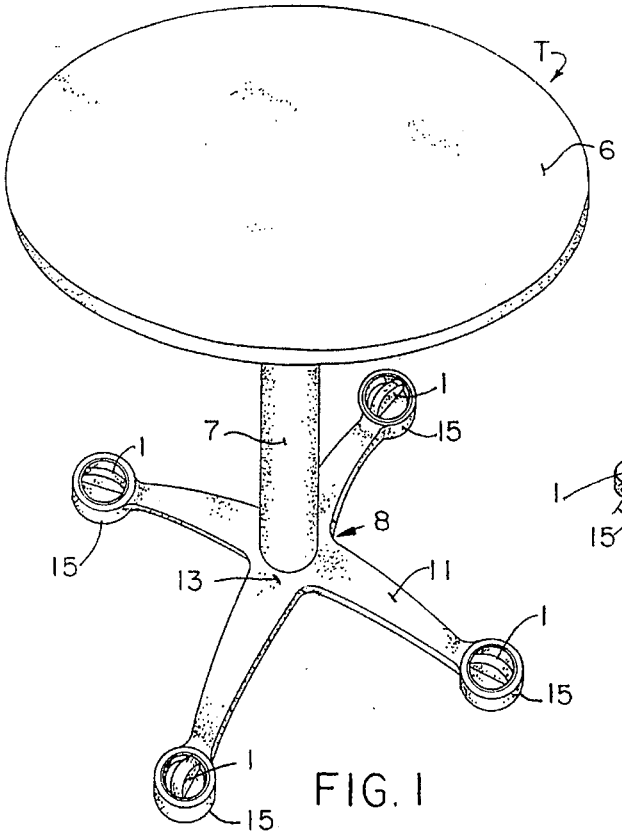
FIG. 1 is an isometric view of a table employing the adjustable leveling glide assembly of the present invention.

The adjustable leveling glide assembly of the present invention is indicated generally be reference numeral 1 in the various drawings. FIG. 1 illustrates the use of four glides 1 in a table T. Table T is a conventional utility or industrial quality table of the type used in restaurants, banquet halls or the like, for example. The table T has a top 6 mounted on a vertical support column 7, which in turn is supported by a base assembly 8. The underside top 6 is attached to the upper end of the column 7 in any conventional manner. The column 7 is constructed from cast iron, steel or other appropriate material.

Figure 2:
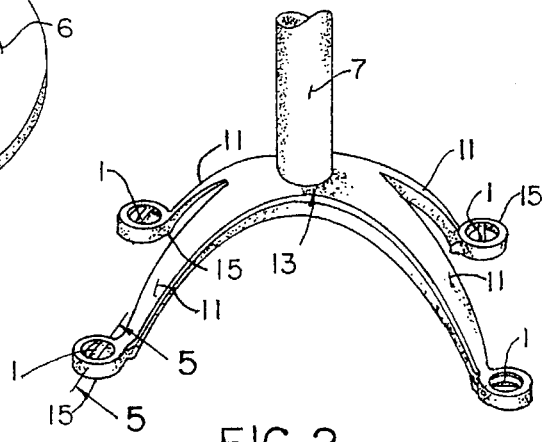
FIG. 2 is an isometric view of a base support assembly employing the adjustable leveling glide assembly of the present invention.

Elements of the base assembly 8 are shown in greater detail in FIGS. 2. The base assembly has four supports or legs 11. The legs 11 are spaced equal distances apart to impart stability to the base assembly 8. The legs 11 converge at a central hub 13. The previously described column 7 is attached at the hub 13 in any conventional manner. It will be appreciated by those skilled in the art that the legs 11 and column 7 may be separately constructed and then interconnected, or the parts may be integrally formed with one another. In any event, the legs 11 extend radially outwardly of the column 7. Although illustrated as having a curved or bow shape, primarily for aesthetic reasons, the legs 11 can assume a variety of configurations. It is important to the invention only that each leg 11 extends outwardly of the support column 7 and terminate at a foot 15.

Figure 3:
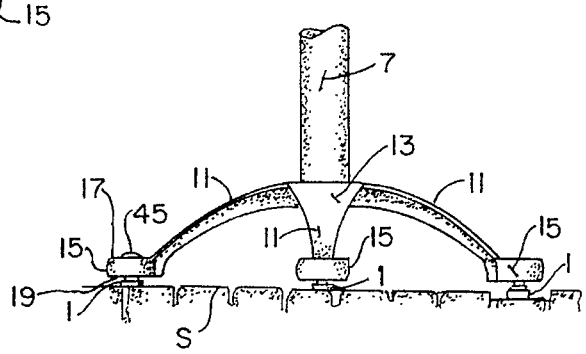
FIG. 3 is a side elevational view thereof, the base positioned on an uneven surface to illustrate environment.
Figure 4:
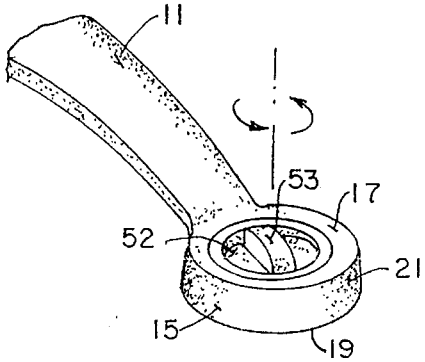
FIG. 4 is a partial isometric view of the horizontal support and foot of a base support assembly employing the adjustable leveling glide assembly of the present invention.
Figure 5:
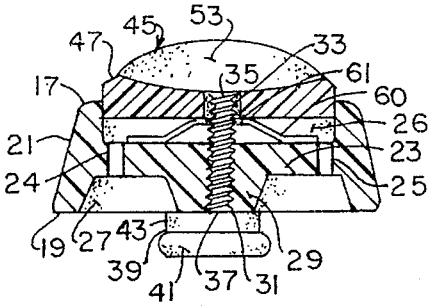
FIG. 5 is an enlarged cross-sectional view of an adjustable leveling glide assembly of the present invention taken along the 5—5 of FIG. 3.
Figure 6:
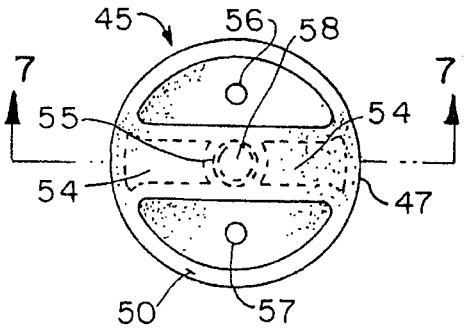
FIG. 6 is a bottom plan of the knob element of the adjustable leveling glide assembly of the present invention.

Each foot 15 is identical and provides a housing for a identical glide 1. As best seen in FIGS. 3 to 5, foot 15 is circular in shape. Other configurations are compatible with the broader aspects of the invention. The foot 15 is horizontally disposed parallel to a surface S on which it rests. In the embodiment illustrated, the foot 15 has a annular top wall 17 and an annular bottom wall 19 which are joined by a circumferential side wall 21. Bottom wall 19 has a greater diameter than top wall 17. Therefore, side wall 21 slightly flares out from top to bottom. The side wall 21 is integrally attached to leg 11 or otherwise appropriately attached to the leg. A material thickness or wall 23 between walls 17 and 19 or extend horizontally across the foot 15, being positioned at the midpoint of the side of wall 21. Wall 23 has a pair of drainage holes 24 and 25 formed therein. Annular top wall 17, side wall 21 and wall 23 define a first chamber part or cavity 26, and annular bottom wall 19 define a second chamber part or cavity 27. The cavities 26 and 27 are separated by the wall 23. Wall 23 has a central depending boss 29 which extends down into cavity 27. Boss 29 has a threaded bore 31 formed centrally therein. Bore 31 can be threaded for can be smooth and have a threaded insert (not shown) positioned in it. It will be appreciated that the supports 11, hub 13 and feet 15 can be constructed from one piece cast iron or other appropriate material or provided as separate elements and appropriately joined together.

A threaded stem 33 extends through threaded bore 31. Stem 33 has a first or upper end 35 and second or lower end 37. A surface engaging support element or glide 39 is attached to the lower end 37 of stem 33. In the preferred embodiment, glide 39 is formed to include a lower flat round or disc portion 41 and a concentric upper portion 43. The disc 41 is constructed to rest on a surface. The glide 39 can be molded as one piece from a resilient resin material such as nylon or delrin or can be provided two separate pieces, i.e. a metal disc 41 and resin concentric portion 43, or vice versa, appropriately joined together. In any event, glide 39 is attached to stem 33 directly by a threaded bore (not shown) through the upper portion 43 or other appropriate attachment means. Alternatively, glide 39 can be connected to stem 33 via an articulating joint means (not shown) that will allow glide 39 to articulate relative to stem 33.

Figure 7:
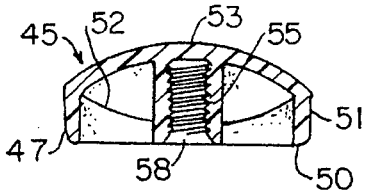
FIG. 7 is a cross-sectional view of the knob element taken along lines 7—7 of FIG. 6.
Figure 8:
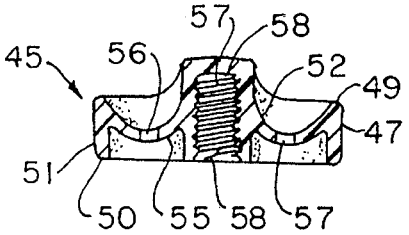
FIG. 8 is a cross-sectional view of the knob element taken along lines 8 of FIG. 8 and 9.
Figure 9:
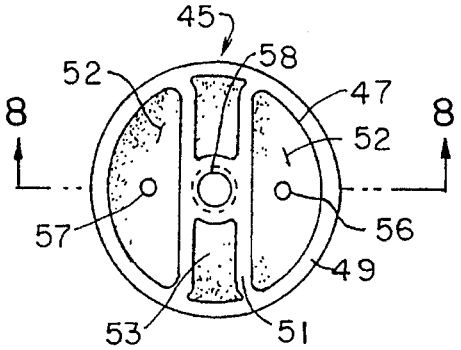
FIG. 9 is a top plan thereof.
Figure 10:
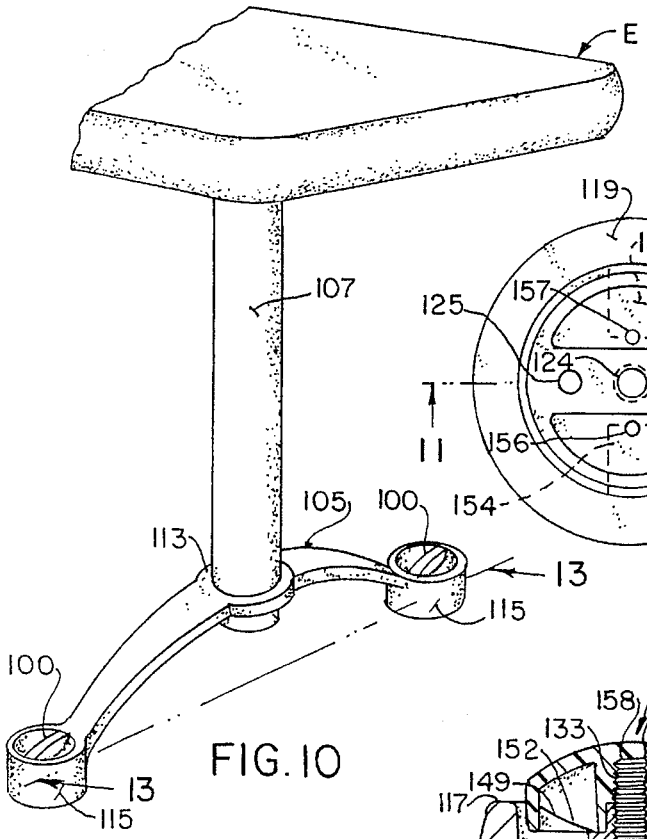
FIG. 10 is a partial isometric view of a second embodiment of an adjustable leveling glide assembly of the present invention.

An adjusting knob 45 is attached to the upper end 35 of stem 33. The knob 45 is shown in greater detail in FIGS. 6 to 10. The adjusting knob 45 is positioned generally within cavity 26. Knob 45, in the embodiment illustrated, is circular and dimensioned to fit in cavity 26 when rotated downward, as will be explained below. Knob 45 has a circular disc portion 47 with a top wall 49, a bottom wall 50, and a side wall 51. Top wall 49 has a slight depression 52 in it. A raised rib 53 extends transversely across top wall 49 and bisects depression 52. Rib 53 has an internal cavity 54 (shown in FIG. 7) about a central column 55 formed within the rib 53. Rib 53 is designed to be used as a handle and grasped between the thumb and forefinger of a user. A first drain hole 56 and a second drain hole 57 are positioned on opposite sides rib 53. The drain holes 56, 77 are formed in the bottom of depression 52, to allow drainage of any liquid spilled on the foot exit the depression. A threaded bore 58 is formed through column 55. Bore 58 is sized to accept the end of the threaded stem 33. Stem 33 is positioned in bore 58 so that the rotation of knob 45 rotates stem 33 as will be explained in detail hereinafter. Knob 45 can be injection molded resin, nylon or other appropriate material. A bias spring 60 is positioned in cavity 26 between wall 23 and knob 45. The spring 60 can be a resilient metal disc or band and has a hole 61 formed centrally in it. Stem 33 is inserted through hole 61. Spring 60 biases knob 45 away from wall 23 and also functions to position and stabilize stem 33 in foot 15.

Glide 1 assembly is used to level a table T resting on an uneven surface S, as shown in FIG. 3. If the table is not level, the user can grasp adjusting knob 45 and rotate it in the desired direction to draw disc 41 toward the foot 15 or move disc 41 away from the foot 15. Rotating the knob 45 in a first or clockwise direction will drive the stem 33 into the bore 31 and move the glide 39 away from the bottom side of the foot 15. Rotating the knob in a second or counterclockwise direction will cause the stem 33 to move up in the bore 31 and draw the glide 39 toward the bottom side of foot 15. When knob 45 is rotated downward, it recedes into cavity 26. Since the knob 45 is position on top of the foot 15, it is easily reached by the user 25 hand or foot and conveniently manipulated. It will be appreciated by those skilled in the art that the knob can assume a variety of configurations to facilitate manipulation. For example, the knob, as shown, is easily grasped and turned by hand. However, the knob can have a top surface configured to allow manipulation by the foot.

Figure 11:
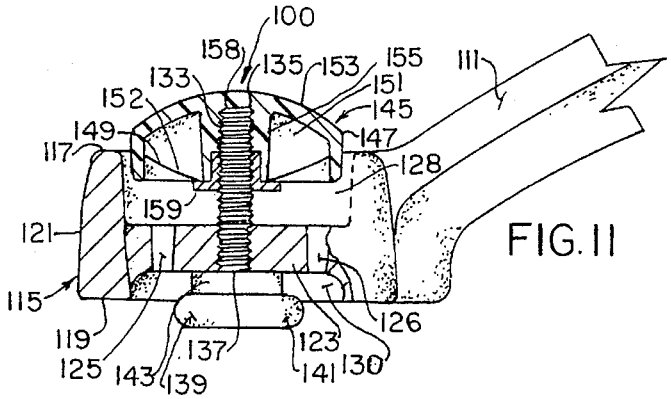
FIG. 11 is an enlarged cross-sectional view of the base assembly of the table shown in FIG. 10 taken along the lines 11—11 of FIG. 10.

FIGS. 11–14 illustrate a second illustrative embodiment of the adjustable leveling glide assembly of the present invention, indicated generally be reference numeral 100 in the drawings. FIG. 11 illustrates the use of two glides assemblies 100, in one end of an elongated table E. Each glide assembly 100 is identical. The table E is a conventional long rectangular table having a base assembly 105 and a vertical support column 107 at each end of table top 109. The upper end of the column 107 is appropriately attached to the under side of the table top 109. Each column 107 is constructed from cast iron, steel or other appropriate material.

Figure 12:
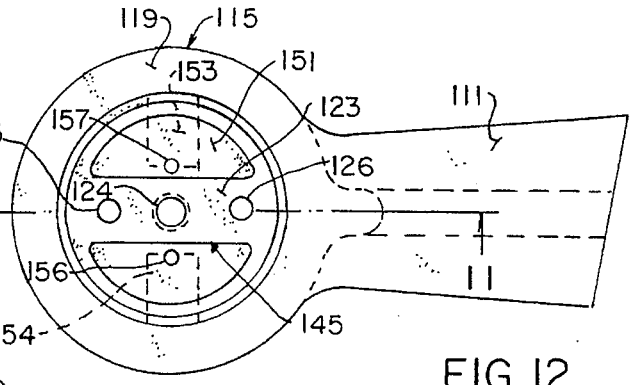
FIG. 12 is a bottom plan of a foot portion of the base assembly.
Figure 13:
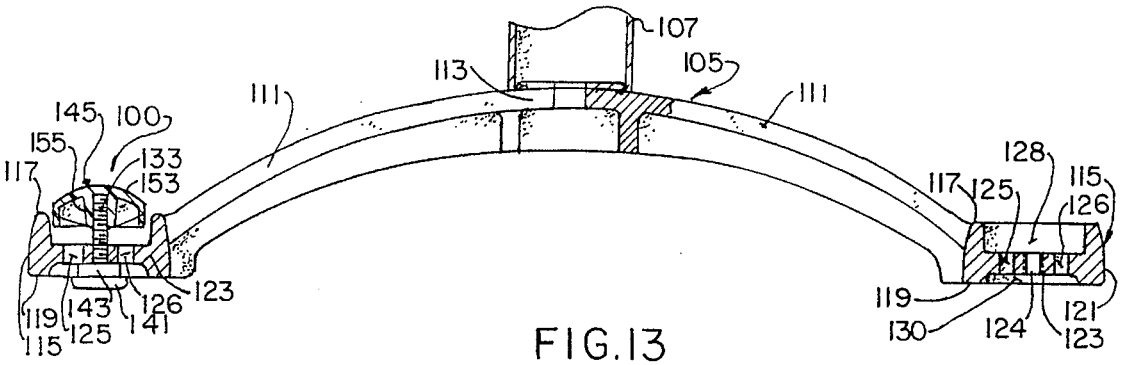
FIG. 13 is a side elevation, partly in a cross-section and partly broken away of the base assembly shown in FIG. 10.

Elements of the base assembly 105 are shown in greater details in FIGS. 12 to 14. The base assembly 105 has two supports or legs 111 positioned directly across from each other. The legs 111 are attached to one another at a hub 113. The vertical column 107 also is attached at the hub 113. The legs 111 are disposed so as to extend outward of the vertical support column 107. Although illustrated as having a bowed shape, the legs 11 can assume any of a variety of configurations. For purposes of clarity of illustration, the legs 111 will be referred to as being horizontally disposed. Each leg 111 terminates in a foot 115. Each foot 115 is identical and provides a housing for glide assembly 100. As best seen in FIG. 13, foot 115 is generally circular in shape. Foot 115 is horizontally disposed and parallel to the surface on which the table is setting. Foot 115 has an annular top wall 117 and an annular bottom wall 119. The respective walls 117 and 119 are joined by a vertical circumferential side wall 121 which is appropriately attached to a leg 111. Foot 115 has an internal cross support 123 that bisects the foot 115. Cross support 123 has a central threaded bore 124 and drain hole 125 and 126 formed therethrough. Wall 121 defines a first or upper cavity 128 above cross support 123 and a second or lower cavity 130 below cross support 123.

Glide assembly 100 is rotatably attached to foot 115. A threaded stem 133 extends through bore 124. Stem 133 has a first or upper end 135 and a second or lower end 137. A glide base 139 is attached to lower end 137. Glide 139 has a lower flat circular portion or disc 141 and a concentric annular upper portion 143. The disc 141 is constructed to rest on a surface such as a floor. The glide 139 can be molded as one piece from a resilient material such as nylon or delrin or provided in two sections, such as a nylon upper portion and a smooth disc properly bonded together. In either case, glide 139 may be attached directly to stem 133. An articulating joint as previously described also may be employed.

An adjusting knob 145 is attached to the upper end 135 of stem 133. The knob is constructed from a resilient material such as nylon or delrin. The knob is generally annular in shape and dimensioned to seat in cavity 126 when rotated down, as previously explained. Knob 145 has a circular base 147 having a top wall 149 and a bottom wall 151. Top wall 149 has a slight depression 152 in the center. There is a transverse raised rib 153 integrally attached to the top wall 149. Rib 153 is hollow and has an internal cavity 154. A cylindrical column 155 is integrally formed within rib 153 and extends into the cavity 154. Rib 153 is designed to be grasped between the thumb and forefinger of a user. A first drain hole 156 in a second drain hole 157 are formed in wall 123 on the opposite sides of rib 153 along the depression 152. A bore 158 is formed in column 155. There is a threaded lock tight washer 159 seated in the bore 158. The upper end 135 of the stem 133 is inserted in lock tight 159. Rotation of knob 145 rotates stem 133.

In use, glide assembly 100 functions the same as glide 1 to level a table. However, the construction of foot 115 allows base 139 to draw up into lower cavity 130 when knob 145 is appropriately rotated in the second direction. This design allows greater extension and greater retraction of the glide, with approximately the same physical dimension of foot 115.

It will be appreciated by those skilled in the art that various changes and modifications can be made in the adjustable glide as described without departing from the scope of the appended claims. Therefore, the foregoing description and accompanying drawings are intended to be illustrative only and should not be construed in a limiting sense.

What is claimed:

1. In a table support assembly to support a table top including at least one vertical column having a first end and a second end, the first end being attached to such table top, at least one generally horizontal support having a first end and a second end, the first end attached to the second end of the vertical column and having a foot at the second end of the horizontal support, the improvement comprising:

an integral foot having an upper and a lower cavity formed therein and a vertical bore formed therethrough, and a glide assembly for permitting adjustment of said glide assembly from an upper side of the foot;

said glide assembly including a threaded stem extending through the vertical bore, said stem having a first end and a second end;

a glide positioned on a lower surface of the foot adjacent the lower cavity and attached to said first end of said stem, and an adjusting knob positioned adjacent the upper cavity and attached to said second end of said stem, said adjusting knob being accessible along an upper side of said foot and adjustable by hand, said knob disposed to rotate said stem within said bore, thereby moving said glide relative to said lower cavity of said foot.

2. The support of claim 1 wherein said foot is circular.

3. The support of claim 1 wherein said adjusting knob is constructed from a resilient resin material.

4. The support assembly of claim 1 wherein said vertical column, said horizontal support and said integral foot are constructed from cast metal.

5. A surface engaging foot integrally formed on the lower end of a support column for supporting a table top, the foot comprising:

a circumferential side wall;

a horizontal wall integrally formed with the circumferential side wall, said circumferential side wall and said horizontal wall defining a top and a bottom chamber with respect to said horizontal wall;

a vertical bore extending through said horizontal wall;

a stem threadedly mounted in said bore, said stem having a first end and a second end;

a glide on said first end of said stem, said glide positioned adjacent said bottom chamber;

an adjusting knob on said second end of said stem and positioned along said top chamber;

said adjusting knob disposed so that rotation of said knob in a first direction moves said glide away from said bottom chamber of said foot and rotation in a second direction moves said glide toward said bottom chamber of said foot.

6. The foot of claim 5 further comprising a bias spring between said adjusting knob and said horizontal wall.

7. The foot of claim 5 wherein said adjusting knob has a transverse raised rib formed thereon to facilitate manipulation of said knob.

8. The foot of claim 5 wherein said glide further comprises a flat surface engaging disc portion and a concentric upper portion, said upper portion having means for attaching to said first end of said threaded stem.

9. The foot of claim 8 wherein said disc portion of said glide is formed from a resilient resin material.

10. The foot of claim 5 wherein said horizontal wall and said circumferential side wall are formed from a cast metal.

11. The foot of claim 9 having at least one drain hole formed therein.

12. The foot of claim 5 wherein said adjusting knob has at least one drain hole formed therein.

13. An integrated leveling device in a table base comprising;

a foot integrally formed from the table base having a circumferential side wall and a horizontal, internal wall having a bore formed therein, said circumferential side wall and internal wall defining an upper cavity and a lower cavity with respect to said internal wall;

a stem positioned in said bore;

a thumb turn knob affixed to an upper end of said stem and positioned along said upper cavity;

a glide affixed to a lower end of said stem and positioned along lower cavity;

wherein the thumb turn knob is readily adjustable from the top of the base so that manipulation of the thumb turn knob in a first direction causes movement of the thumb turn knob inwardly of said upper cavity and the corresponding movement of the glide outwardly of said lower cavity and manipulation of the thumb turn knob in a second direction causes movement of the thumb turn knob outwardly of said upper cavity and the corresponding movement of the glide inwardly of said lower cavity.

14. An integral leveling device in a table base comprising:

a foot integrally formed from the table base having a circumferential side wall and a horizontal internal wall, said internal wall having a threaded bore formed centrally therein, said circumferential side wall and said internal wall defining an upper chamber and a lower chamber;

a threaded stem engaged in said threaded bore;

an adjusting knob secured to an upper end of said threaded stem and position at said upper chamber;

a glide secured to a lower end of said threaded stem and positioned at said lower chamber;

wherein the adjusting knob is readily accessed and adjustable from the top of the table base so that rotation of the knob in a first direction moves the knob downwardly in the upper chamber and moves the glide away from the lower chamber and rotation of the knob in a second direction moves the knob upwardly in the upper chamber and moves the glide toward the lower chamber.

15. A support assembly for a second structure, said support assembly comprising:

a support having a first end and a second end, one of said first and said ends being attached to said second structure;

a foot attached to the other of said first and said second ends of said support, said foot including:

at least one side wall defining a cavity;

a second wall dividing said cavity into an upper chamber and a lower chamber with respect to said second wall;

a bore in said second wall;

a stem mounted for movement in said bore, said stem having a first end and a second end;

a glide on the first end of said stem, said glide positioned adjacent said lower chamber;

an adjusting knob on the second end of said stem and positioned along said upper chamber;

said adjusting knob disposed so that movement of said knob in a first direction moves said glide away from said lower chamber and movement of said knob in a second direction moves said glide towards said lower chamber.

16. The support assembly of claim 15 further including a spring biased between said adjusting knob and said second wall.

17. The support of claim 15 wherein said foot has an opening formed in it, said opening defining a drain for permitting the flow of liquid through said foot.

18. The support of claim 15, wherein said adjusting knob has an opening formed in it, said opening defining a drain for permitting the flow of liquid through said foot.

19. The support of claim 15, wherein said side wall defines an annular structure, and said second wall is integrally formed with said side wall.

* * * * *